US008474744B2

(12) United States Patent
Jacquart

(10) Patent No.: US 8,474,744 B2
(45) Date of Patent: Jul. 2, 2013

(54) FLOOR COVERING STORAGE, DISPENSING AND RETRIEVAL RACK WITH BLOWER DEVICE

(75) Inventor: Robert J. Jacquart, Ironwood, MI (US)

(73) Assignee: Jacquart Fabric Products, Inc., Ironwood, MI (US)

( * ) Notice: Subject to any disclaimer, the term of this patent is extended or adjusted under 35 U.S.C. 154(b) by 477 days.

(21) Appl. No.: 12/725,895

(22) Filed: Mar. 17, 2010

(65) Prior Publication Data

US 2011/0226888 A1 Sep. 22, 2011

(51) Int. Cl.
*B65H 16/02* (2006.01)

(52) U.S. Cl.
USPC ..... 242/557; 242/615.11

(58) Field of Classification Search
USPC ..... 15/40, 88.1, 256.5; 242/557, 615.11; 226/97.3
See application file for complete search history.

(56) References Cited

U.S. PATENT DOCUMENTS

| | | | | |
|---|---|---|---|---|
| 2,145,438 | A | 1/1939 | Thulin | |
| 2,487,083 | A | 11/1949 | Warshaw | |
| 3,618,157 | A * | 11/1971 | Bassin | 15/330 |
| 5,590,435 | A | 1/1997 | Kostigian | |
| 6,302,280 | B1 * | 10/2001 | Bermes | 211/70.6 |
| 6,474,956 | B2 * | 11/2002 | Davis et al. | 417/234 |
| 6,536,610 | B1 * | 3/2003 | Taylor | 211/70.6 |
| 6,692,240 | B1 * | 2/2004 | Leonhard et al. | 417/372 |
| 6,820,725 | B2 | 11/2004 | Kostigian et al. | |
| 7,496,983 | B2 | 3/2009 | Kostigian | |
| 2006/0096047 | A1 | 5/2006 | Kostigian | |
| 2006/0125197 | A1 | 6/2006 | Kostigian | |
| 2009/0065457 | A1 | 3/2009 | Kostigian | |

FOREIGN PATENT DOCUMENTS

| | | | |
|---|---|---|---|
| CA | 2 484 454 | A1 | 5/2006 |

* cited by examiner

*Primary Examiner* — Sang Kim

(74) *Attorney, Agent, or Firm* — Andrus, Sceales, Starke & Sawall, LLP

(57) ABSTRACT

A floor covering storage, dispensing and retrieval rack includes a frame having a roller arrangement for enabling storage, dispensing and retrieval of at least one roll of floor covering relative to the floor surface. A blower device is connected to the frame for supplying a stream of forced air between the floor surface and the floor covering to ease installation and removal of the floor covering relative to the floor surface.

20 Claims, 4 Drawing Sheets

FLOOR COVERING STORAGE, DISPENSING AND RETRIEVAL RACK WITH BLOWER DEVICE

FIELD OF THE INVENTION

The present disclosure generally relates to a rack for storing, dispensing and retrieving one or more rolls of floor covering relative to a floor surface, such as a gymnasium floor. More particularly, the present disclosure pertains to a rack provided with a forced air assist device for easing installation and removal of the floor covering relative to the floor surface.

BACKGROUND OF THE INVENTION

The use of gymnasium floors for activities and social gatherings other than sporting events has always caused concern that the quality of the floor finish will deteriorate due to street shoes being worn, or from tables, chairs and other abrasive items. It has therefore become the practice to cover gymnasium floors with sheets of thin floor covering material typically composed of suitable synthetic materials such as vinyl. The floor covering is normally formed on at least an underside thereof with a textured, slip-resistant layer used in maintaining the position of the floor covering on the gymnasium floor surface.

Floor covering racks are well known for storage and dispensing purposes. The floor covering is stored on rotatable rolls on a rack and can be conveniently withdrawn and laid on the floor. The floor covering is conveniently retrieved by rotating the roller by means of a crank or an electric motor.

In the course of using these known racks to dispense and retrieve floor covering, it has been found that the combined floor covering weight and friction occurring between the underside of the floor covering and the floor surface may hamper installation and removal as well as cause scuffing or scratching of the floor surface.

Therefore, it is desirable to overcome the deficiencies of the prior art, and provide a floor covering storage, dispensing and retrieval rack equipped with a forced air assist device in the form of a blower, as well as a method of use, for simplifying and expediting installation and removal of the floor covering while reducing the potential of floor surface damage during either process.

SUMMARY OF THE INVENTION

The present disclosure relates to a rack having a frame provided with at least one roller for enabling storage, dispensing and retrieval of a roll of floor covering relative to a floor surface. A blower device is associated with the frame for providing a cushion of forced air between the floor surface and the floor covering to assist in the dispensing and retrieval of the floor covering. In an exemplary embodiment, the blower device is movably mounted on a support structure positioned between the frame and the floor surface.

In another aspect of the disclosure, a floor covering storage, dispensing and retrieval rack includes a frame having a roller arrangement for enabling storage, dispensing and retrieval of at least one roll of floor covering relative to a floor surface wherein the floor covering is rollably supported from the roller arrangement. A blower device is connected to the frame for supplying a stream of forced air between the floor surface and the floor covering to ease installation and removal of the floor covering relative to the floor surface.

In the example disclosed, the frame includes a base formed with front and rear members interconnected by a pair of side members. A first upright side structure is secured between the front and rear members and spaced inwardly from one of the side members. A second upright side structure is secured between the front and the rear members and spaced inwardly of the other of the side members. The first and second upright side structures are joined at upper and lower ends thereof.

The roller arrangement includes a plurality of rollers rotatably mounted between the first and second upright side structures in a vertically spaced apart parallel relationship above the front and the rear members of the base with each roller supporting a roll of floor covering. Extendable members are provided on opposite ends of the side members, and the side members are provided with upright support members for holding the extendable members when the extendable members are removed from the opposite ends of the side members. Ground engaging wheels are provided on the base and the extendable members.

The base includes floor locking brakes for preventing movement of the frame during installation and removal of the floor covering. The rollers are rollably supported in end brackets extending forwardly and rearwardly of the first and second upright side structures. A support structure for the blower device is suspended from the frame, and is interconnected between the front and rear members and located between the first and second upright side structures. The support structure has a bottom support surface spaced above the floor surface and formed with side support rails that are joined to a pair of cross members extending transversely between the front and the rear members. The support structure has open front and rear ends to permit the stream of air from the blower device to flow freely along the floor surface. The blower device has a duct for directing the cushion of forced air located beneath the base.

The disclosure further contemplates a method of dispensing and retrieving floor covering relative to a floor surface. The method includes the steps of a) providing a rack with a roller arrangement for supporting at least one roll of floor covering thereon such that the floor covering is rollably dispensed and retrieved relative to the roller arrangement and the floor surface; and b) supplying a blower device for providing a cushion of air between the floor surface and the floor covering to assist in the dispensing and retrieval of the floor covering relative to the floor surface. In using the method described above, the rack has a base for supporting the roller arrangement, and the blower device has a duct located between the base and the floor surface. The blower device is mounted on a support structure suspended from the base.

BRIEF DESCRIPTION OF THE DRAWINGS

The best mode of carrying out the invention is described herein below with reference to the following drawing figures.

DETAILED DESCRIPTION

Figure 1:
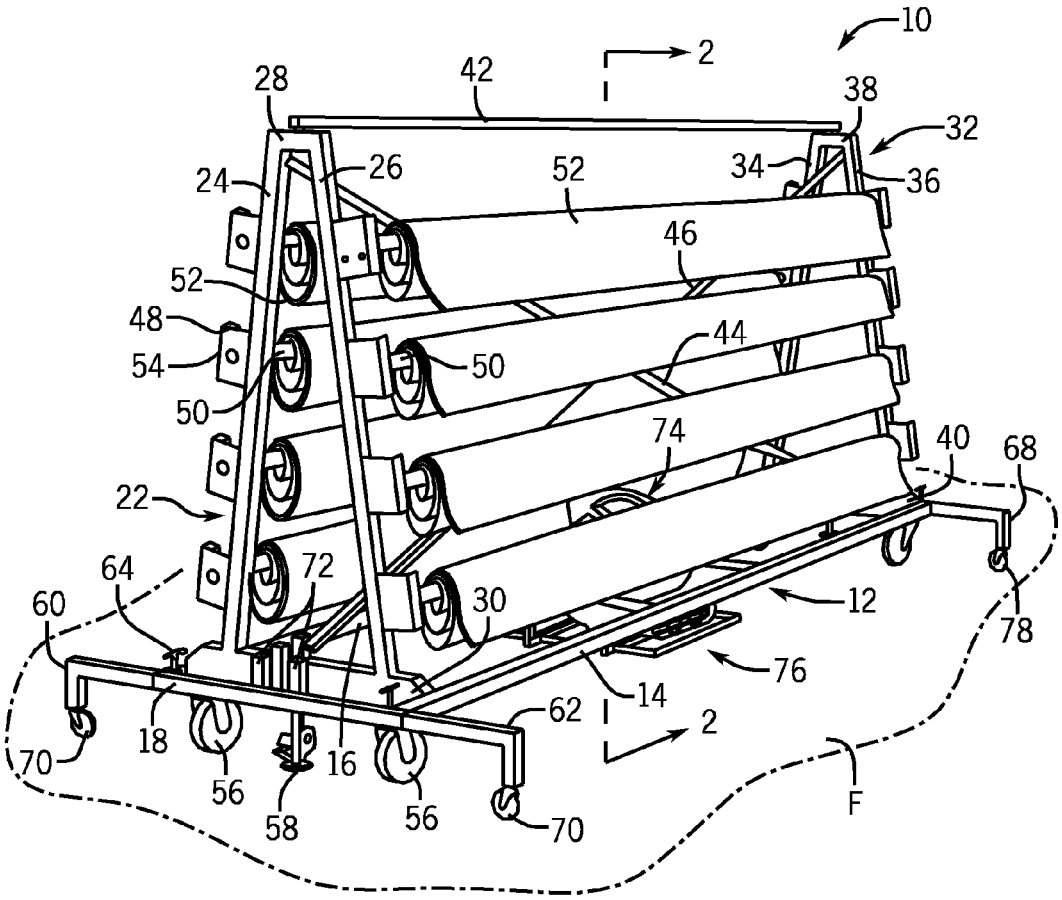
FIG. 1 is a perspective view of a floor covering storage, dispensing, and retrieval rack provided with a blower device in accordance with the present disclosure.
Figure 2:
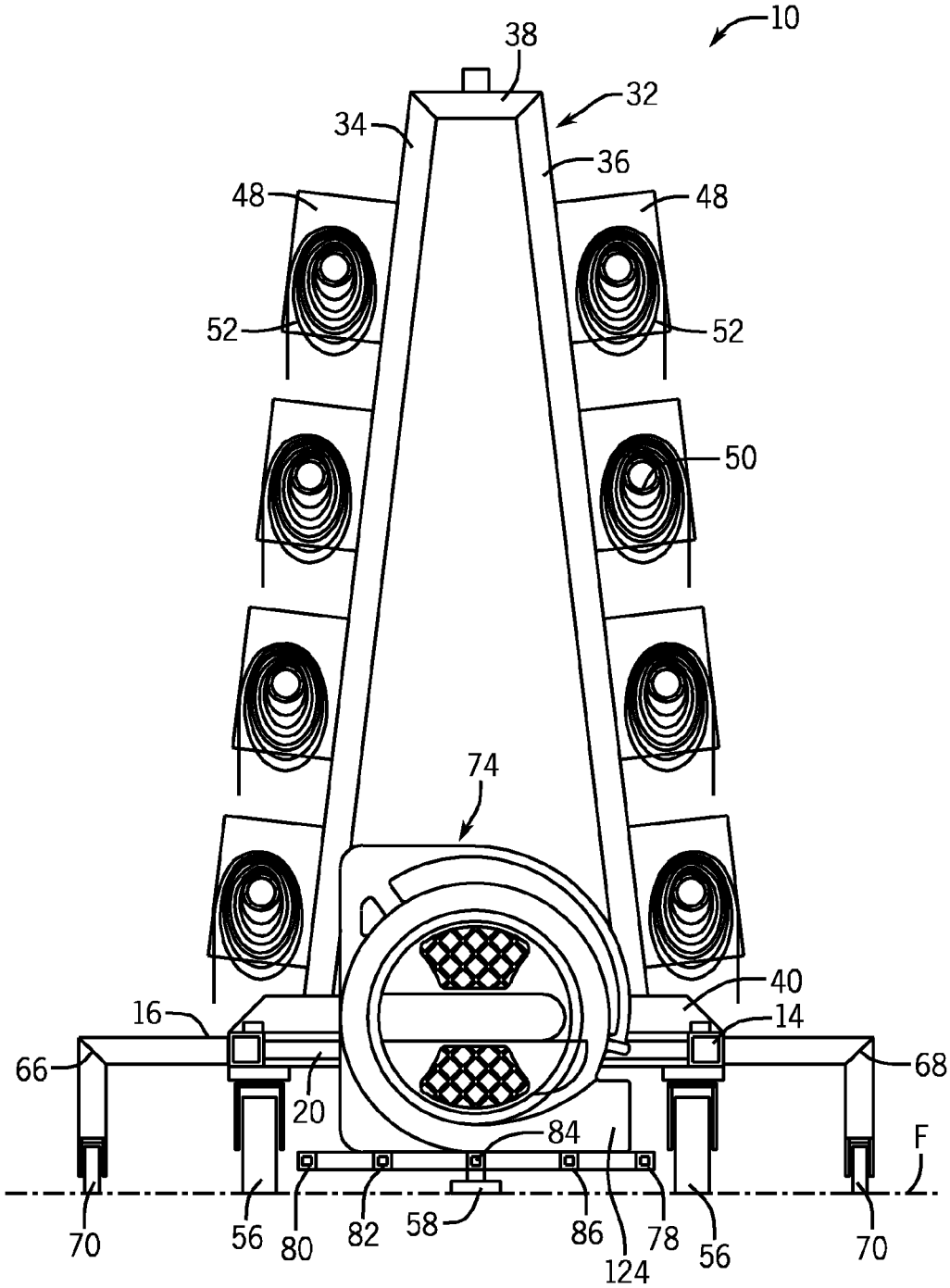
FIG. 2 is a sectional view taken on line 2-2 of FIG. 1.
Figure 3:
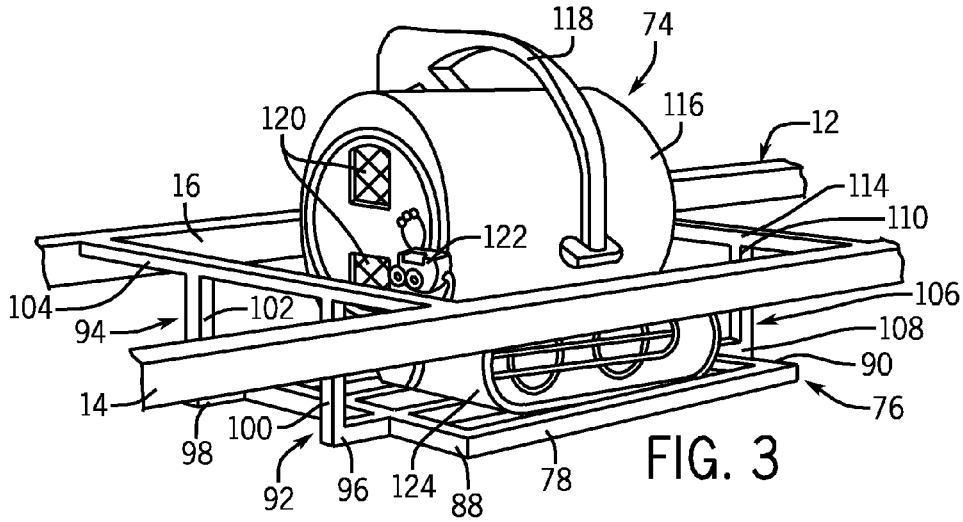
FIG. 3 is a detailed perspective view of the blower device depicted in FIGS. 1 and 2.

Referring now to the drawings, FIGS. 1-6 illustrate an exemplary embodiment of a floor covering storage, dispensing, and retrieval rack 10 in accordance with the present disclosure. The rack 10 includes a frame 12 typically constructed of rigid tubular members and having a rectangular base defined by front and rear members 14 and 16, respectively, interconnected by side members 18 and 20. A first upright side structure 22 includes uprights 24 and 26 connected at upper ends by a top member 28 and at lower ends by a bottom member 30. The bottom member 30 is interconnected between the front and the rear members 14 and 16, respectively, and is spaced inwardly from side member 18. A second upright side structure 32 includes uprights 34 and 36 connected at upper ends by a top member 38 and at lower ends by a bottom member 40. The bottom member 40 is interconnected between the front and rear members 14 and 16, respectively, and is spaced inwardly from side member 20. The top members 28 and 38 are joined together by a top rail 42, and diagonal braces 44 and 46 are provided to reinforce the frame 12.

A series of spaced apart end brackets 48 is secured rearwardly to the uprights 24 and 34, and forwardly to uprights 26 and 36. The brackets 48 are configured to rotatably mount a group of rollers 50, each of which supports a roll of floor covering 52, typically formed of a synthetic material such as vinyl. The rollers 50 are arranged in a vertically spaced, parallel and generally symmetrical balanced relationship above the front and rear members 14 and 16, respectively, of the frame 12. Certain of the end brackets 48 on uprights 24 and 36 are formed with holes 54 in communication with open ends of the rollers 50 adapted to receive manual cranking means or electrically driven cranking means, as is well known. In the example shown, the frame 12 is provided with eight rollers 50 for storing, dispensing and retrieving up to eight rolls of floor covering 52, but it should be appreciated that the frame 12 may be designed to hold more or less rolls of floor covering 52 in a similar balanced arrangement as desired.

The frame 12 is movably supported relative to a floor surface F by four rubber tired swivel casters 56, with one pair being secured to a bottom of side member 18 and the other pair being secured to a bottom of side member 20. The casters 56 enable the rack 10 to be conveniently moved about on the floor surface F in different directions from one location to another, such as from a storage area to a gymnasium floor. Floor locking brakes or anchors 58 are provided on the bottom of the frame 12 for engagement with the floor surface F so that during dispensing and retrieving operations, the rack 10 will remain stationary.

In order to reduce the risk of tipping, the base of the rack 10 is preferably provided with outriggers defined by extendable members to expand the frame 12 during loading and unloading of floor covering 52. In the example shown, a first pair of L-shaped extendable members 60, 62 have inner ends which are slidably secured and retained in opposite open ends of side members 18 and 20 by means of retaining pins 64 which hold the extendable members 60, 62 in selected positions at the front and rear of rack 10. Similarly, a second pair of extendable members 66, 68 are provided for opposite side member 20. Outer bottom ends of the L-shaped extendable members 60, 62, 66 and 68 are provided with casters 70 which are typically smaller in size as compared with casters 56. As seen in FIG. 1, tubular support members 72 extend upwardly at the side member 18 of the frame 12 for holding the L-shaped extendable members 60, 62 in a storage position when the floor covering 52 is not being dispensed or retrieved. Similar support members are provided at the side member 20 for extendable members 66, 68.

To assist in dispensing and retrieving floor covering relative to rack 10, the frame 12 includes a blower device 74 which is positioned on a support structure 76 (FIG. 3) interconnected between the front and rear members 14 and 16, respectively, and located between the upright side structures 20 and 32. The support structure 76 has a bottom support surface formed by a front rail 78, a rear rail 80, three intermediate rails 82, 84, 86 and side rails 88, 90. One pair of L-shaped support rails 92, 94 has horizontal legs 96, 98 extending laterally from side rail 88, and vertical legs 100, 102 extending upwardly for connection to a cross member 104 running transversely across the rear members 14 and 16, respectively. Another pair of L-shaped support rails (one being seen at 106, FIG. 3) has horizontal legs, such as shown at 108, extending laterally from side rail 90, and vertical legs 110, 112 (FIG. 4) extending upwardly for connection to a cross member 114 running transversely across front and rear members 14 and 16, respectively. With this construction, the support structure 76 is held suspended from the front and rear members 14 and 16, and the blower device 74 is supported on a bottom support surface which is held spaced above the floor surface F as seen in FIGS. 2-6.

In the example shown, the blower device 74 is a commercially available electrically powered blower including a housing 116 provided with a handle 118, vents 120, controls 122 and a duct 124 appropriately sized to direct a stream of forced air (as depicted by arrow A in FIG. 6) along a floor surface F and beneath a lower surface of floor covering 52. The support structure 76 has open front and rear ends to permit the stream of air to flow unobstructed beneath the frame 12. The blower device 74 may have a cord connected to a source of AC power such as a wall outlet, or may be battery powered. The blower 74 may be actuated manually using the controls 122, but is preferably remotely controlled. While the blower device 74 shown in the exemplary embodiment is a single unit with a single duct 124 and is supported on a lower portion of the frame 12, it is contemplated that the blower device 74 may be embodied in other suitable forms and arrangements in association with the frame 12 for providing one or more similar air streams along the floor surface.

Figure 4:
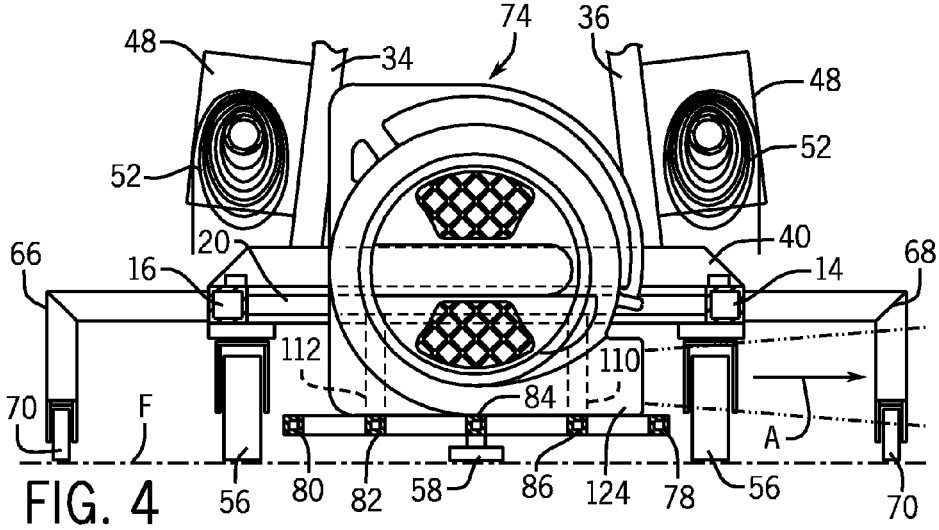
FIG. 4 is a fragmentary view of a lower portion of FIG. 2 depicting a representative air stream produced by the blower device.

In use, the rack 10, having been provided in the example shown with up to eight rolls of floor covering 52, is moved from a storage to a dispensing position with the outriggers 60, 62, 66 and 68 in place. The floor locking brakes 58 are locked and the blower device 74, as positioned in FIG. 4, is actuated to deliver a stream of forced air along floor surface F. Floor covering 52 is then unrolled typically by two installers starting with the uppermost roll positioned above the front member 14. The installers walk the floor covering 52 being unrolled along the floor surface F and then lay down and adjust the floor covering 52. As the floor covering 52 is unrolled, the air stream delivered from the duct 124 of the blower device 74 engages a lower surface of the floor covering 52. The air stream floats or lifts the floor covering 52 on a cushion of air to ease installation and adjustment thereof, while minimizing scuffing or scratching the floor surface F in the process. Once the floor covering 52 is laid down on the floor surface F, any adjustment of the floor covering 52 is expedited due to the air cushion which helps to overcome the weight and frictional drag of the floor covering 52.

Figure 5:
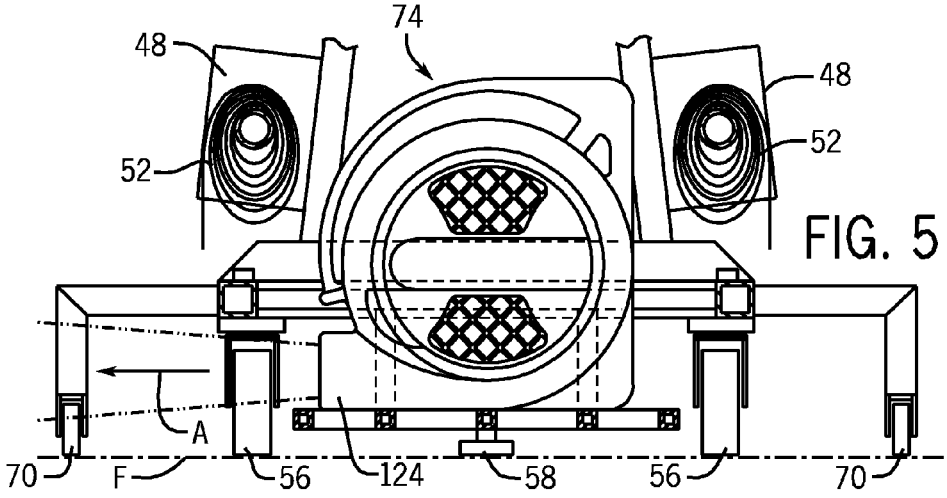
FIG. 5 is a view similar to FIG. 4 showing the position of the rack and the blower device being reversed from the position shown in FIG. 4.
Figure 6:
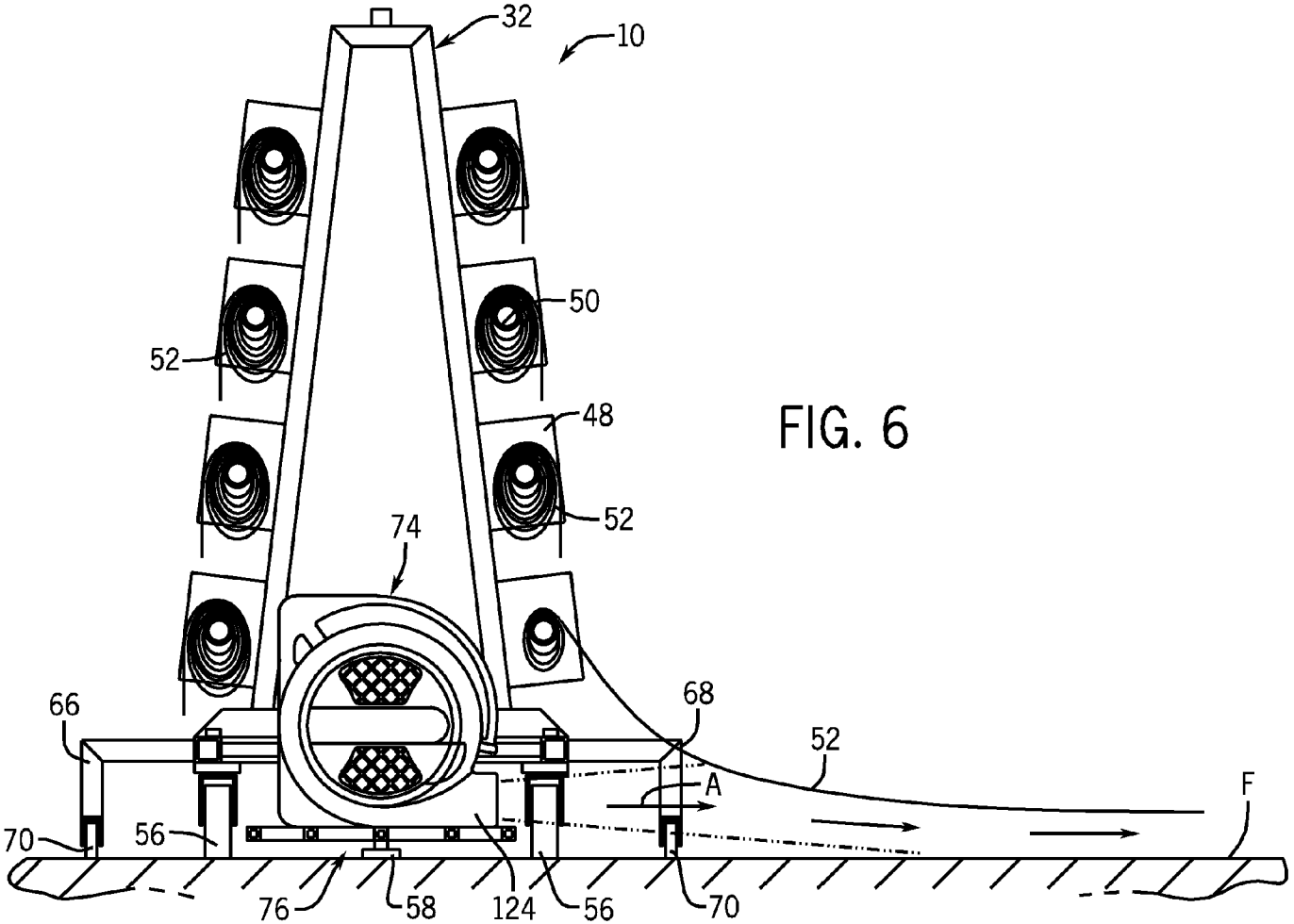
FIG. 6 is a view similar to FIG. 2 illustrating the dispensing or retrieval of floor covering using the blower device.

After the first roll of floor covering 52 is installed, the floor locking brakes 58 are released and the rack 10, as well as the position of the blower device 74 on support structure 76, is reversed, as shown in FIG. 5, so that upon reengaging the floor locking brakes 58, floor covering 52 on the uppermost roll positioned above rear member 16 can be installed with the similar air lift or air cushion assist as described above. Adjacent layers of floor covering 52 are secured together along overlapping side edges thereof. Installation continues in a similar fashion successively with the lower rolls of floor covering 52 until the rack 10 is unloaded.

When the floor covering 52 is to be retrieved, the rack 10, with the floor locking brakes 58 locked, is positioned adjacent one end of a floor covering 52 that is attached to a lowermost roller 50 which is rotated by a hand or power crank while an air stream is generated beneath the floor covering 52 by the blower device 74. The air cushion provided by the blower device 74 again creates a lift effect to help reduce the frictional drag normally encountered when retrieving the floor covering 52 from the floor surface F without the blower device 74. As a result, retrieval is made easier and faster while minimizing scuffing and scratching of the floor surface F.

The rack 10 in combination with the blower device 74 thus provides a work-saving, floor-saving roll out system which simplifies and expedites installation and removal of floor covering relative to a floor surface while retaining the protection thereof.

Various alternatives are contemplated as being within the scope of the following claims particularly pointing out and distinctly claiming the subject matter regarded as the invention.

What is claimed is:

1. A floor covering storage, dispensing and retrieval rack comprising:

a frame;

at least one roller mounted to the frame for enabling storage, dispensing and retrieval of at least one roll of a floor covering relative to a floor surface; and a blower device supported by the frame and positioned to supply a stream of forced air between the floor surface and the floor covering to ease installation and removal of the floor covering relative to the floor surface.

2. The rack of claim 1, wherein the frame comprises a base formed with front and rear members interconnected by a pair of side members;

a first upright side structure secured between the front and rear members and spaced inwardly of one of the side members; and a second upright side structure secured between the front and rear members and spaced inwardly of the other of the side members, the first and second upright side structures being joined at upper and lower ends thereof, wherein the rack includes a plurality of rollers rotatably mounted between the first and second upright side structures in a vertically spaced apart parallel relationship above the front and rear members of the base, each roller supporting a roll of the floor covering.

3. The rack of claim 2, wherein extendable members are provided on opposite ends of the side members.

4. The rack of claim 3, wherein the side members are provided with upright support members for holding the extendable members when the extendable members are removed from the opposite ends of the side members.

5. The rack of claim 3, wherein ground engaging wheels are provided on the base and the extendable members.

6. The rack of claim 2, wherein the base includes floor locking brakes for preventing movement of the frame during installation and removal of the floor covering.

7. The rack of claim 2, wherein the rollers are rollably supported in end brackets extending forwardly and rearwardly of the first and second upright side structures.

8. The rack of claim 2, wherein the blower device is positioned between the first and second upright side structures.

9. The rack of claim 1, wherein a support structure for the blower device is suspended from the frame.

10. The rack of claim 9, wherein the support structure for the blower device is interconnected between front and rear members of the frame.

11. The rack of claim 10, wherein the support structure has a bottom support surface spaced above the floor surface and formed with side support rails that are joined to a pair of cross members extending transversely between the front and rear members.

12. The rack of claim 11, wherein the support structure has open front and rear ends to permit the stream of air from the blower device to flow freely along the floor surface through either the open front or rear ends.

13. The rack of claim 1, wherein the blower device has a duct for directing the cushion of forced air beneath the floor covering.

14. A method of dispensing and retrieving floor covering relative to a floor surface, the method comprising the steps of:

a) providing a rack with a roller arrangement for supporting at least one roll of floor covering thereon such that the floor covering is rollably dispensed and retrieved relative to the roller arrangement and the floor surface;

b) mounting a blower device on the rack for movement with the rack, the blower being operable to provide a stream of air; and c) activating the blower device to create the stream of air between the floor surface and the floor covering to assist in the dispensing and retrieval of the floor covering relative to the floor surface.

15. The method of claim 14, wherein the rack has a base for supporting the roller arrangement and the blower device has a duct located between the base and the floor surface.

16. The method of claim 14, wherein the blower device is mounted on a support structure suspended from the base.

17. A floor covering rack for storing, dispensing and retrieval of at least one roll of a floor covering relative to a floor surface, comprising:

a frame having front and rear members joined to each other and a plurality of ground engaging wheels to facilitate movement of the rack along the floor surface;

at least one roller mounted to the frame for dispensing and retrieval of the at least one roll of the floor covering;

a support structure suspended beneath the frame; and a blower device supported on the support structure, wherein the blower device creates a stream of forced air between the floor surface and the floor covering to ease installation and removal of the floor covering relative to the floor surface.

18. The rack of claim 17 wherein the support structure has open front and rear ends to permit the stream of air from the blower device to flow freely along the floor surface through either the open front or rear ends.

19. The rack of claim 18 wherein the blower device is movably mounted to the support structure to selectively direct the stream of air through either the open front end or the open rear end.

20. The rack of claim 17 wherein the blower device has a duct for directing the stream of forced air beneath the floor covering.

* * * * *